US011428048B2

(12) United States Patent
Xiao et al.

(10) Patent No.: US 11,428,048 B2
(45) Date of Patent: Aug. 30, 2022

(54) DRILLING SYSTEM AND METHOD OF SUBMARINE DRILLING RIG

(71) Applicant: CHINA UNIVERSITY OF PETROLEUM, Qingdao (CN)

(72) Inventors: Wensheng Xiao, Qingdao (CN); Junguo Cui, Qingdao (CN); Lianpeng Mei, Qingdao (CN); Han Pang, Qingdao (CN); Jian Liu, Qingdao (CN); Yongtian Kang, Qingdao (CN); Haiyang Zhao, Qingdao (CN); Wenqiang Zou, Qingdao (CN); Simiao Liu, Qingdao (CN); Linchuan Zhang, Qingdao (CN); Kang Li, Qingdao (CN)

(73) Assignee: CHINA UNIVERSITY OF PETROLEUM, Qingdao (CN)

( * ) Notice: Subject to any disclaimer, the term of this patent is extended or adjusted under 35 U.S.C. 154(b) by 201 days.

(21) Appl. No.: 16/797,785

(22) Filed: Feb. 21, 2020

(65) Prior Publication Data

US 2020/0270951 A1 Aug. 27, 2020

(30) Foreign Application Priority Data

Feb. 23, 2019 (CN) ..... 201910162171.7

(51) Int. Cl.
*E21B 7/124* (2006.01)
*E21B 4/04* (2006.01)
(Continued)

(52) U.S. Cl.
CPC ..... *E21B 7/124* (2013.01); *E21B 4/04* (2013.01); *E21B 19/008* (2013.01); *E21B 21/06* (2013.01); *E21B 21/106* (2013.01); *E21B 17/206* (2013.01)

(58) Field of Classification Search
CPC ..... E21B 17/206; E21B 19/008; E21B 21/06; E21B 21/106; E21B 4/04
See application file for complete search history.

(56) References Cited

U.S. PATENT DOCUMENTS 3,095,048 A * 6/1963 O'Neill ..... E21B 19/20 175/6
3,934,660 A * 1/1976 Nelson ..... B65H 75/425 175/102
2016/0251907 A1* 9/2016 Walker ..... E21B 3/02 175/5

* cited by examiner

*Primary Examiner* — James G Sayre
(74) *Attorney, Agent, or Firm* — Hauptman Ham, LLP

(57) ABSTRACT

The present invention discloses a drilling system and method of a submarine drilling rig, relating to the technical field of drilling equipment. The system includes a barge, an umbilical cable, a submarine device and a drilling device; where the barge is loaded with a pneumatic-electric-hydraulic control device and a mud treatment device which are respectively connected to the submarine device through the umbilical cable; and the submarine device includes a submarine traveling device, a coiled tubing roller, a derrick, a centralized valve seat, a drill bit replacement device, a wellhead device and a casing rack. The centralized valve seat is connected to the umbilical cable for shunting mud, cement and electrical signals conveyed by the umbilical cable. The derrick is installed above the wellhead device, respectively matched with the drill bit replacement device and the casing rack for replacing drill bits and conveying and withdrawing casings. The drilling device is connected to the coiled tubing for performing drilling operations. The present invention has the advantages of low cost, high drilling and production efficiency and high safety.

20 Claims, 3 Drawing Sheets

(51) Int. Cl.

| | |
|---|---|
| ***E21B 19/00*** | (2006.01) |
| ***E21B 21/10*** | (2006.01) |
| ***E21B 21/06*** | (2006.01) |
| ***E21B 17/20*** | (2006.01) |

DRILLING SYSTEM AND METHOD OF SUBMARINE DRILLING RIG

TECHNICAL FIELD

The present invention relates to the technical field of drilling equipment, and in particular to a drilling system and method of a submarine drilling rig.

BACKGROUND

The ocean is a huge treasure house of mankind and has a large amount of resources. The exploration and development of offshore oil and other energy sources such as combustible ice has become a major strategic demand for China's energy development. The seabed is also rich in mineral resources. Cobalt-rich crusts are mainly distributed on tops and slopes of seamounts or submarine plateaus with a depth of 1000-3000 m; and hydrothermal polymetallic sulphides are mainly distributed at the top of active ocean ridges with a water depth of 2600 m. In the resource investigation of submarine mineral resources such as the cobalt-rich crusts and the hydrothermal polymetallic sulphides, it is necessary to acquire samples by a drilling system of a submarine drilling rig.

In conventional offshore drilling, a drilling rig system is disposed on a drilling platform or a drilling ship, and is composed of a rotating system, a hoisting system, a circulation system, a control system, a drilling rig base, an auxiliary device, etc like a land drilling rig system. With the increase of the drilling depth, a current deepwater offshore platform drilling rig has some problems in aspects of drilling cost, drilling efficiency, technical difficulty, safety, which restrict the efficient development process of deep sea energy in China.

Therefore, there is an urgent need to develop a drilling system suitable for deep sea energy development to promote the development of China's marine engineering equipment and realize the strategic goal of sustainable development of China's oil and gas resources.

SUMMARY

Therefore, technical problems to be solved by embodiments of the present invention are high drilling cost, low drilling efficiency and poor safety of a deepwater offshore platform drilling rig in the prior art.

To resolve the above problems, the present invention provides drilling system of a submarine drilling rig, including: a barge, an umbilical cable, a submarine device and a drilling device;

where the barge is loaded with a pneumatic-electric-hydraulic control device and a mud treatment device; the pneumatic-electric-hydraulic control device and the mud treatment device are respectively connected to the submarine device through the umbilical cable, and the barge is used as a mud and cement circulation base station as well as a control center;

the submarine device includes a submarine traveling device, a coiled tubing roller, a derrick, a centralized valve seat, a drill bit replacement device, a wellhead device and a casing rack, where the coiled tubing roller, the derrick, the centralized valve seat, the drill bit replacement device, the wellhead device and the casing rack are loaded to the submarine traveling device; the centralized valve seat is connected to the umbilical cable for shunting mud, cement and electrical signals conveyed by the umbilical cable; the coiled tubing roller is used to store and release coiled tubing; the derrick is installed above the wellhead device, respectively matched with the drill bit replacement device and the casing rack for replacing drill bits and conveying and withdrawing casings; and the drilling device is connected to the coiled tubing for performing drilling operations.

Preferably, the submarine traveling device is provided with at least two groups of track wheels.

Preferably, the submarine traveling device includes a water filling and draining buoyancy tank and a power positioning device;

the water filling and draining buoyancy tank is used to achieve floating and sitting at the bottom by filling with water and draining; and the power positioning device is used to provide power for the submarine traveling device to drive the submarine traveling device to travel and position the submarine traveling device.

Preferably, the derrick includes a drilling derrick and a casing running derrick, the drilling derrick is provided with an injection head for receiving coiled tubing from the coiled tubing roller and conveying coiled tubing to the wellhead device, and the casing running derrick is provided with a casing installation and dismantling device for grabbing a casing from the casing rack for casing running operations.

Preferably, the casing installation and dismantling device is electrically driven.

Preferably, the drilling device includes a downhole drilling permanent magnet motor and a drill bit, and an end of the downhole drilling permanent magnet motor is connected to the coiled tubing to drive the drill bit to perform drilling operations.

Preferably, an output end of the downhole drilling permanent magnet motor is connected to the drill bit.

Preferably, the submarine traveling device and the coiled tubing roller are driven by a hydraulic motor or driven electrically.

Preferably, the centralized valve seat and the drill bit replacement device are placed in a closed watertight caisson.

The present invention further provides a drilling method of a submarine drilling rig, including the following steps of:

loading an umbilical cable, a submarine device and a drilling device to a barge and transporting to a designated sea area;

placing down the submarine device and the drilling device to a seabed by the barge, and controlling a submarine traveling device by a pneumatic-electric-hydraulic control device to move to a designated position;

starting a mud treatment device to perform mud circulation treatment during drilling and casing running operations;

controlling, by the pneumatic-electric-hydraulic control device, a casing installation and dismantling device to grab a casing from a casing rack to complete surface layer casing running; then controlling a drill bit replacement device to complete drill bit replacement; then controlling a downhole drilling permanent magnet motor to drive a drill bit to complete drilling operations; and controlling, by the pneumatic-electric-hydraulic control device, to convey cement through the umbilical cable to complete cementing operations.

The technical solutions of the embodiments of the present invention have the following advantages:

1. According to a drilling system of a submarine drilling rig provided by the embodiment of the present invention, by arranging a submarine device, a complete set of drilling device is moved to a seabed for direct drilling operations, which is less affected by wind waves and currents. Control operations are performed through a pneumatic-electric-hydraulic control device on a barge, and a coiled tubing drilling mode is adopted. This saves operation time for drill pipe dismantling and underwater appliance placing and recycling and the like, reduces drilling cost, improves drilling and production efficiency, greatly reduces labor intensity of workers, and improves safety of drilling workers.

2. Through a shunt step of a centralized valve seat of the submarine device, a drilling method of a submarine drilling rig provided by the embodiment of the present invention achieves centralized and unified shunt distribution of conveyed mud, cement, electrical signals and the like, simplifies routes, reduces cost, facilitates safe maintenance and improves the system safety. By setting the submarine direct drilling operation step, the drilling device is less affected by wind waves and currents. The coiled tubing drilling mode is adopted. This saves operation time for drill pipe dismantling and underwater appliance placing and recycling and the like, reduces drilling cost and improves drilling and production efficiency.

BRIEF DESCRIPTION OF THE DRAWINGS

To describe the technical solutions in the embodiments of the present invention art more clearly, the following briefly introduces accompanying drawings required for describing the embodiments. Apparently, the accompanying drawings in the following description show merely some embodiments of the present invention, and a person of ordinary skill in the art may still derive other accompanying drawings from these accompanying drawings without creative efforts.

Figure 1:
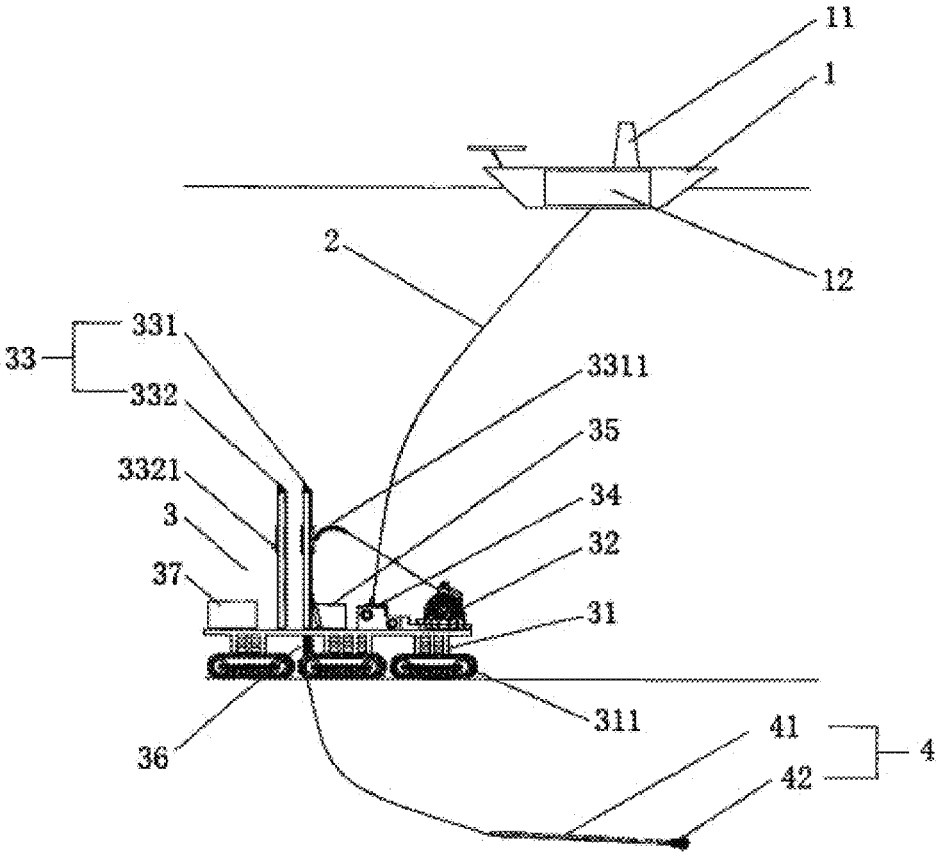
FIG. 1 is a schematic structural diagram of a specific example of a drilling system of a submarine drilling rig in Embodiment 1 of the present invention.

Reference numerals: 1. barge, 11. pneumatic-electric-hydraulic control device, 12. mud treatment device, 2. umbilical cable, 3. submarine device, 31. submarine traveling device, 311. track wheel, 32. coiled tubing roller, 33. derrick, 331. drilling derrick, 3311. injection head, 332. casing running derrick, 3321. casing installation and dismantling device, 34. centralized valve seat, 35. drill bit replacement device, 36. wellhead device, 37. casing rack, 4. drilling device, 41. downhole drilling permanent magnet motor, 42. drill bit, 5. closed watertight caisson, 51. first container wall, 52. second container wall, 53. third container wall, 54. first channel, 55. waterproof membrane, 56. second channel, 57. airtight door, 58 humidity sensor, 59. third channel.

DETAILED DESCRIPTION

The following clearly and completely describes the technical solutions of the present invention with reference to accompanying drawings. Apparently, the described embodiments are merely some rather than all of the embodiments of the present invention. All other embodiments obtained by a person of ordinary skill in the art based on the embodiments of the present invention without creative efforts shall fall within the protection scope of the present invention.

In the description of the present invention, it should be noted that the terms used herein are for the purpose of describing specific embodiments only and are not intended to limit the present invention. As used herein, the singular forms "a", "an" and "the" are intended to include the plural forms, unless the context clearly indicates otherwise. When the terms such as "comprise" and/or "include" are used, it is intended to indicate the presence of such features, integers, steps, operations, elements, and/or components, but does not exclude the presence or addition of one or more other features, integers, steps, operations, elements, components, and/or other combinations. Orientations or position relationships indicated by terms "center", "top", "bottom", "left", "right", "vertical", "horizontal", "inside", "outside", and the like are orientation or position relationships as shown in the accompanying drawings, and these terms are just used to facilitate description of the present invention and simplify the description, but not to indicate or imply that the mentioned device or elements must have a specific orientation and must be established and operated in a specific orientation, and thus, these terms cannot be understood as a limitation to the present invention. The terms "installation", "connected with", and "connected to" should be understood in a broad sense. For example, these terms may be comprehended as being fixedly connected, detachably connected or integrally connected; mechanically connected or electrically connected; directly connected or indirectly connected through an intermediate medium, or in an internal communication between two elements; or wirelessly connected or in wired connection. A person of ordinary skill in the art may understand specific meanings of the foregoing terms in the present invention based on a specific situation.

In addition, the technical features involved in the various embodiments of the present invention described below may be combined with each other as long as they do not constitute a conflict with each other.

Embodiment 1

This embodiment provides a drilling system of a submarine drilling rig. As shown in FIG. 1, the system includes: a barge 1, an umbilical cable 2, a submarine device 3 and a drilling device 4.

The barge 1 is loaded with a pneumatic-electric-hydraulic control device 11 and a mud treatment device 12 and further loaded with, for example, a driller room; the pneumatic-electric-hydraulic control device 11 and the mud treatment device 12 are respectively connected to the submarine device 3 through the umbilical cable 2, and the barge 1 is used as a mud and cement circulation base station as well as a control center.

The submarine device 3 includes a submarine traveling device 31, a coiled tubing roller 32, a derrick 33, a centralized valve seat 34, a drill bit replacement device 35, a wellhead device 36 and a casing rack 37, where the coiled tubing roller 32, the derrick 33, the centralized valve seat 34, the drill bit replacement device 35, the wellhead device 36 and the casing rack 37 are loaded to the submarine traveling device 31; the centralized valve seat 34 is connected to the umbilical cable 2 for shunting mud, cement and electrical signals conveyed by the umbilical cable 2; the coiled tubing roller 32 is used to store and release coiled tubing; the derrick 33 is installed above the wellhead device 36, respectively matched with the drill bit replacement device 35 and the casing rack 37 for replacing drill bits and conveying and withdrawing casings; and the drilling device 4 is connected to the coiled tubing for performing drilling operations.

A preferred solution of the submarine traveling device 31 is to provide at least two groups of track wheels 311. As shown in FIG. 1, the submarine traveling device 31 is provided with three groups of track wheels 311. Another preferred solution is that the submarine traveling device includes a water filling and draining buoyancy tank and a power positioning device. The water filling and draining buoyancy tank is used to achieve floating and sitting at the bottom by filling with water and draining. The power positioning device is used to provide power for the submarine traveling device to drive the submarine traveling device to travel and position the submarine traveling device.

Preferably, the derrick 33 includes a drilling derrick 331 and a casing running derrick 332, the drilling derrick 331 is provided with an injection head 3311 for receiving coiled tubing from the coiled tubing roller 32 and conveying coiled tubing to the wellhead device 36, and the casing running derrick 332 is provided with a casing installation and dismantling device 3321 for grabbing a casing from the casing rack 37 for casing running operations.

Preferably, the casing installation and dismantling device 3321 is electrically driven.

Preferably, the drilling device 4 includes a downhole drilling permanent magnet motor 41 and a drill bit 42, and an end of the downhole drilling permanent magnet motor 41 is connected to the coiled tubing to drive the drill bit 42 to perform drilling operations.

Preferably, an output end of the downhole drilling permanent magnet motor 41 is connected to the drill bit 42.

Preferably, the submarine traveling device 31 and the coiled tubing roller 32 are driven by a hydraulic motor or driven electrically.

Preferably, the centralized valve seat 34 and the drill bit replacement device 35 are placed in a closed watertight caisson. The injection head 3311 is also placed in the closed watertight caisson.

Figure 2:
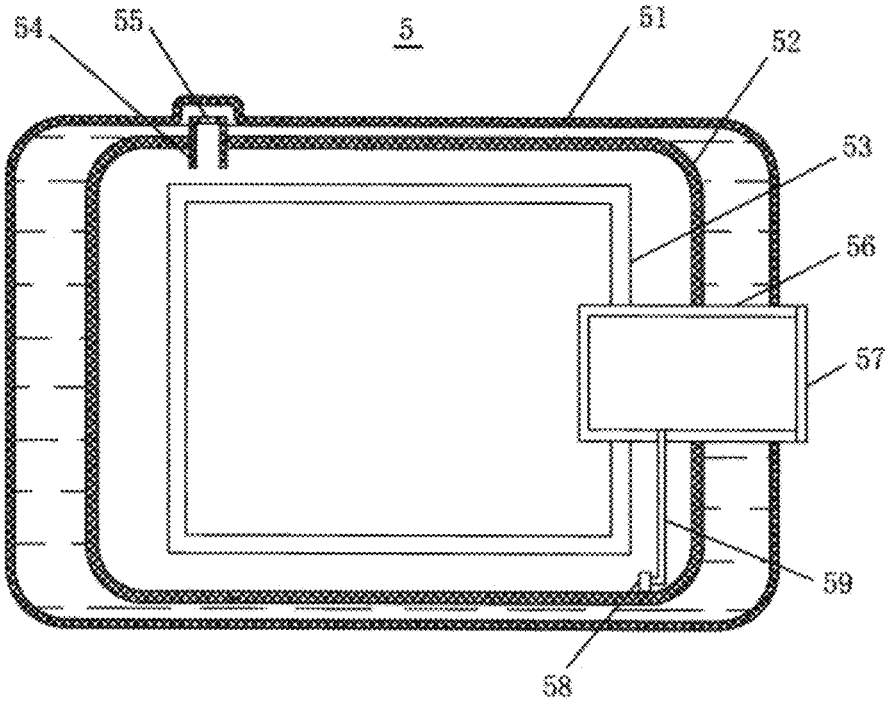
FIG. 2 is a schematic structural diagram of a specific example of a closed watertight caisson in Embodiment 1 of the present invention.
Figure 3:
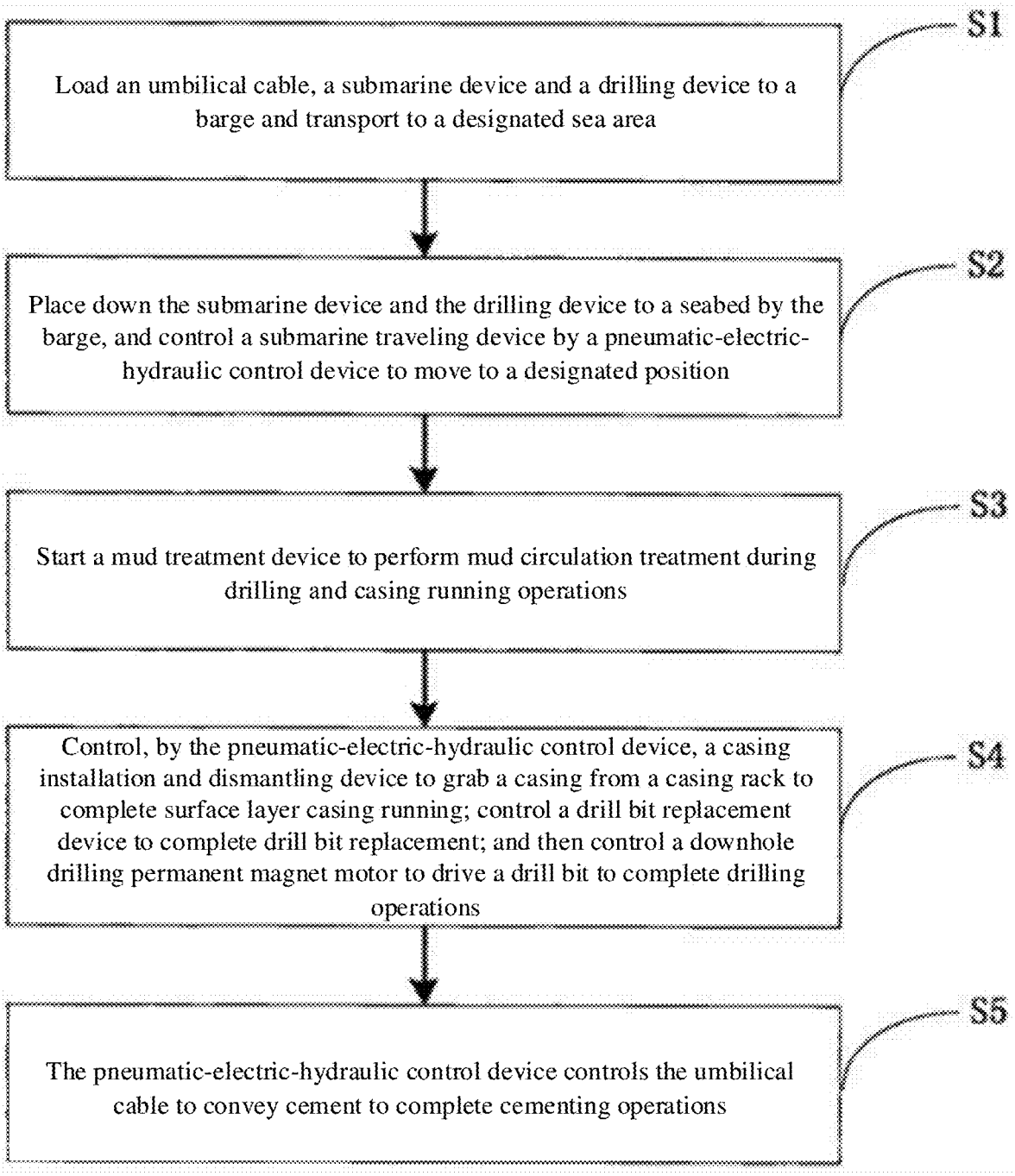
FIG. 3 is a flowchart of a specific example of a drilling method of a submarine drilling rig in Embodiment 2 of the present invention.

Preferably, as shown in FIG. 2, the closed watertight caisson 5 includes a first container wall 51, a second container wall 52, a third container wall 53, a first channel 54, a waterproof membrane 55, a second channel 56, an airtight door 57, a humidity sensor 58 and a third channel 59 from outside to inside. A space defined by the third container wall 53, the second container wall 52 and the first container wall 51 is a closed space, and its pressure resistance gradually increases. The third container wall 53 is located in a space defined by the second container wall 52, and the second container wall 52 is located in a space defined by the first container wall 51. The first channel 54 is disposed on the second container wall 52 and used for communicating a space sandwiched between the first container wall 51 and the second container wall 52 with a space sandwiched between the second container wall 52 and the third container wall 53. A certain amount of liquid is pre-stored in the space sandwiched between the first container wall 51 and the second container wall 52, and the space sandwiched between the second container wall 52 and the third container wall 53 is pre-filled with gas with a certain pressure. The waterproof membrane 55 seals and is connected to an upper port of the first channel 54. The second channel 56 communicates the space defined by the third container wall 53 with the outside. Cables connected to the centralized valve seat 34, the drill bit replacement device 35 or the injection head and a device (communication with the outside) in the closed watertight caisson pass through the airtight door 57 in the second channel 56 for output. The humidity sensor 58 is installed at the bottom of an inner side of the second container wall 52 and used for detecting the presence or absence of liquid in the space defined by the second container wall 52. A signal line of the humidity sensor 58 is connected to the pneumatic-electric-hydraulic control device 11 through the third channel 59 which is in sealing connection with the second channel. The closed watertight caisson has an overpressure damage alarm function. When the closed watertight caisson descends to an ultra-deep seabed under the pressure that the first container wall 51 cannot bear, the first container wall 51 and the waterproof membrane 55 burst at the same time, so that the gas with a certain pressure rushes out, and the liquid flows into the space defined by the second container wall 52. The humidity sensor 58 detects the current humidity and transmits the result to the pneumatic-electric-hydraulic control device 11, and the pneumatic-electric-hydraulic control device 11 judges the humidity change and generates an alarm signal, to prohibit the submarine traveling device from continuing to descend or to control the submarine traveling device to return. This prevents the submarine pressure after further descending from damaging the third container wall 53 and damaging internal devices, thus improving safety.

During submarine drilling operations, the barge 1 firstly transports the complete set of drilling device of the drilling system of a submarine drilling rig to a designated sea area, then the submarine device 3 is placed to the seabed, and the mud treatment device 12 located in a cabin of the barge 1 completes the mud circulation treatment during drilling and casing running operations. The mud circulation treatment is performed during the whole drilling or casing running operations. The barge 1 is connected to the submarine device 3 through the umbilical cable 2 to convey mud, cement, electrical signals and the like to the centralized valve seat 34 of the submarine drilling rig, and then shunting is performed. In this case, the barge can be seen as a mud and cement circulation base station as well as a control center of the drilling system of the submarine drilling rig. After the submarine device 3 is placed down to the seabed, the submarine traveling device 31 is controlled to move to a designated place by the pneumatic-electric-hydraulic control device 11. Then, the pneumatic-electric-hydraulic control device 11 controls the casing installation and dismantling device 3321 to grab a casing from the casing rack 37 to run the surface layer casing. Then the pneumatic-electric-hydraulic control device 11 controls the drill bit replacement device 35 to replace the drill bit and then the downhole drilling permanent magnet motor 41 directly drills the drill bit 42 to perform drilling operations. The mud treatment device 12 of the barge conveys cement through the umbilical cable 2 to perform cementing operations.

According to the drilling system of a submarine drilling rig, by arranging a submarine device, a complete set of drilling device is moved to a seabed for direct drilling operations, which is less affected by wind waves and currents. Control operations are performed through a pneumatic-electric-hydraulic control device on a barge, and a coiled tubing drilling mode is adopted. This saves operation time for drill pipe dismantling and underwater appliance placing and recycling and the like, reduces drilling cost, improves drilling and production efficiency, greatly reduces labor intensity of workers, and improves safety of drilling workers.

Embodiment 2

This embodiment provides a drilling method of a submarine drilling rig, which includes the following steps:

S1: Load an umbilical cable 2, a submarine device 3 and a drilling device 4 to a barge 1 and transport to a designated sea area.

S2: Place down the submarine device 3 and the drilling device 4 to a seabed by the barge 1, and control a submarine traveling device 31 by a pneumatic-electric-hydraulic control device 11 to move to a designated position; where a transmission path of a control signal generated by actions of the pneumatic-electric-hydraulic control device 11 such as controlling the movement of the submarine traveling device 31 is as follows: the control signal is transmitted to the centralized valve seat 34 of the submarine device through the umbilical cable 2 and is shunted through the centralized valve seat 34 and then sent to the submarine traveling device 31. In the following steps, transmission paths of the control signal sent by the pneumatic-electric-hydraulic control device 11 are basically the same. That is, the control signal is shunted by the centralized valve seat 34 and then sent, and the difference is that the control signal is sent to different controlled objects.

Preferably, during the traveling process of the submarine traveling device 31, the pneumatic-electric-hydraulic control device 11 performs the tightness detection of the closed watertight caisson in real time. The specific steps include:

acquiring, by the pneumatic-electric-hydraulic control device 11, a humidity value detected by the humidity sensor 58 in real time, and judging according to the humidity value whether the closed watertight caisson is damaged or leaked (for example, when the humidity value is greater than or equal to a preset value, a judgment result of the damaged or leaked closed watertight caisson is obtained, otherwise, the closed watertight caisson is not damaged or leaked); and when the closed watertight caisson is damaged or leaked, controlling the submarine traveling device 31 to stop or return, thereby improving safety.

S3: Start a mud treatment device 12 to perform mud circulation treatment during drilling and casing running operations, where the mud circulation treatment is performed during the whole drilling or casing running operations.

S4: Control, by the pneumatic-electric-hydraulic control device 11, a casing installation and dismantling device 3321 to grab a casing from a casing rack 37 to complete surface layer casing running; then control a drill bit replacement device 35 to complete drill bit replacement; and then control a downhole drilling permanent magnet motor 41 to drive a drill bit 42 to complete drilling operations.

S5: The pneumatic-electric-hydraulic control device 11 controls the umbilical cable 2 to convey cement to complete cementing operations.

Through a shunt step of a centralized valve seat of the submarine device, the drilling method of a submarine drilling rig achieves centralized and unified shunt distribution of conveyed mud, cement, electrical signals and the like, simplifies routes, reduces cost, facilitates safe maintenance and improves the system safety. By setting the submarine direct drilling operation step, the drilling device is less affected by wind waves and currents. The coiled tubing drilling mode is adopted. This saves operation time for drill pipe dismantling and underwater appliance placing and recycling and the like, reduces drilling cost and improves drilling and production efficiency.

It is apparent that the foregoing embodiments are merely examples for the clarity of the description, and are not intended to limit the implementations. Those skilled in the art may also make changes or modifications in other different forms based on the foregoing description. There is no need and no way to exhaust all of the implementations. Obvious changes or modifications made thereto shall still fall within the protection scope of the present invention.

What is claimed is:

1. A drilling system of a submarine drilling rig, comprising: a barge, an umbilical cable, a submarine device and a drilling device;

wherein the barge is loaded with an electric-hydraulic control device and a mud treatment device; the electric-hydraulic control device and the mud treatment device are respectively connected to the submarine device through the umbilical cable, and the barge is used as a mud and cement circulation base station as well as a control center;

the submarine device comprises a submarine traveling device, a coiled tubing roller, a derrick, a centralized valve seat, an iron roughneck, a wellhead device and a casing rack, wherein the coiled tubing roller, the derrick, the centralized valve seat, the iron roughneck, the wellhead device and the casing rack are loaded to the submarine traveling device; the centralized valve seat is connected to the umbilical cable for shunting mud, cement and electrical signals conveyed by the umbilical cable; the coiled tubing roller is used to store and release coiled tubing; the derrick is installed above the wellhead device, respectively matched with the iron roughneck and the casing rack for replacing drill bits and conveying and withdrawing casings; and the drilling device is connected to the coiled tubing for performing drilling operations.

2. The drilling system of a submarine drilling rig according to claim 1, wherein the submarine traveling device is provided with at least two groups of track wheels.

3. The drilling system of a submarine drilling rig according to claim 2, wherein the derrick comprises a drilling derrick and a casing running derrick, the drilling derrick is provided with an injection head for receiving coiled tubing from the coiled tubing roller and conveying coiled tubing to the wellhead device, and the casing running derrick is provided with a casing installation and dismantling device for grabbing a casing from the casing rack for casing running operations.

4. The drilling system of a submarine drilling rig according to claim 2, wherein the casing installation and dismantling device is electrically driven.

5. The drilling system of a submarine drilling rig according to claim 2, wherein the drilling device comprises a downhole drilling permanent magnet motor and a drill bit, and an end of the downhole drilling permanent magnet motor is connected to the coiled tubing to drive the drill bit to perform drilling operations.

6. The drilling system of a submarine drilling rig according to claim 1, wherein the submarine traveling device comprises a water filling and draining buoyancy tank and a power positioning device;

the water filling and draining buoyancy tank is used to achieve floating and sitting at the bottom by filling with water and draining; and the power positioning device is used to provide power for the submarine traveling device to drive the submarine traveling device to travel and position the submarine traveling device.

7. The drilling system of a submarine drilling rig according to claim 6, wherein the derrick comprises a drilling derrick and a casing running derrick, the drilling derrick is provided with an injection head for receiving coiled tubing from the coiled tubing roller and conveying coiled tubing to the wellhead device, and the casing running derrick is provided with a casing installation and dismantling device for grabbing a casing from the casing rack for casing running operations.

8. The drilling system of a submarine drilling rig according to claim 6, wherein the casing installation and dismantling device is electrically driven.

9. The drilling system of a submarine drilling rig according to claim 6, wherein the drilling device comprises a downhole drilling permanent magnet motor and a drill bit, and an end of the downhole drilling permanent magnet motor is connected to the coiled tubing to drive the drill bit to perform drilling operations.

10. The drilling system of a submarine drilling rig according to claim 1, wherein the derrick comprises a drilling derrick and a casing running derrick, the drilling derrick is provided with an injection head for receiving coiled tubing from the coiled tubing roller and conveying coiled tubing to the wellhead device, and the casing running derrick is provided with a casing installation and dismantling device for grabbing a casing from the casing rack for casing running operations.

11. The drilling system of a submarine drilling rig according to claim 10, wherein the casing installation and dismantling device is electrically driven.

12. The drilling system of a submarine drilling rig according to claim 10, wherein the drilling device comprises a downhole drilling permanent magnet motor and a drill bit, and an end of the downhole drilling permanent magnet motor is connected to the coiled tubing to drive the drill bit to perform drilling operations.

13. The drilling system of a submarine drilling rig according to claim 1, wherein the casing installation and dismantling device is electrically driven.

14. The drilling system of a submarine drilling rig according to claim 13, wherein the drilling device comprises a downhole drilling permanent magnet motor and a drill bit, and an end of the downhole drilling permanent magnet motor is connected to the coiled tubing to drive the drill bit to perform drilling operations.

15. The drilling system of a submarine drilling rig according to claim 1, wherein the drilling device comprises a downhole drilling permanent magnet motor and a drill bit, and an end of the downhole drilling permanent magnet motor is connected to the coiled tubing to drive the drill bit to perform drilling operations.

16. The drilling system of a submarine drilling rig according to claim 15, wherein an output end of the downhole drilling permanent magnet motor is connected to the drill bit.

17. The drilling system of a submarine drilling rig according to claim 1, wherein the submarine traveling device and the coiled tubing roller are driven by a hydraulic motor or driven electrically.

18. The drilling system of a submarine drilling rig according to claim 17, wherein the centralized valve seat and the iron roughneck are placed in a closed watertight caisson.

19. The drilling system of a submarine drilling rig according to claim 17, wherein the submarine traveling device and the coiled tubing roller are driven by a hydraulic motor or driven electrically.

20. A drilling method of a submarine drilling rig, comprising the following steps of:

loading an umbilical cable, a submarine device and a drilling device to a barge and transporting to a designated sea area;

placing down the submarine device and the drilling device to a seabed by the barge, and controlling a submarine traveling device by an electric-hydraulic control device to move to a designated position;

starting a mud treatment device to perform mud circulation treatment during drilling and casing running operations;

controlling, by the electric-hydraulic control device, a casing installation and dismantling device to grab a casing from a casing rack to complete surface layer casing running; then controlling an iron roughneck to complete drill bit replacement; then controlling a downhole drilling permanent magnet motor to drive a drill bit to complete drilling operations; and controlling, by the electric-hydraulic control device, the mud treatment device to convey cement through the umbilical cable to complete cementing operations.

* * * * *